US012290743B2

(12) United States Patent
Ming

(10) Patent No.: US 12,290,743 B2
(45) Date of Patent: May 6, 2025

(54) ICE AND SNOW DUAL-PURPOSE SLIDING DEVICE

(71) Applicant: Changcheng Ming, Shenzhen (CN)

(72) Inventor: Changcheng Ming, Shenzhen (CN)

( * ) Notice: Subject to any disclaimer, the term of this patent is extended or adjusted under 35 U.S.C. 154(b) by 77 days.

(21) Appl. No.: 18/495,758

(22) Filed: Oct. 27, 2023

(65) Prior Publication Data

US 2024/0050832 A1 Feb. 15, 2024

Related U.S. Application Data

(63) Continuation of application No. PCT/CN2021/092607, filed on May 10, 2021.

(30) Foreign Application Priority Data

Apr. 28, 2021 (CN) ..... 202110468653.2

(51) Int. Cl.
*A63C 1/30* (2006.01)
*A63C 5/025* (2006.01)

(52) U.S. Cl.
CPC ..... *A63C 5/025* (2020.08); *A63C 1/30* (2013.01)

(58) Field of Classification Search
CPC ..... A63C 17/18; A63C 13/003; A63C 5/044; A63C 13/006; A63C 1/02; A63C 5/056;
(Continued)

(56) References Cited

U.S. PATENT DOCUMENTS 7,222,440 B2 * 5/2007 Dombowsky ..... A43B 3/16 36/97
8,876,144 B1 * 11/2014 Darnell ..... A63C 13/003 280/611

(Continued)

FOREIGN PATENT DOCUMENTS

CN 200939330 8/2007
CN 103948208 7/2014

(Continued)

OTHER PUBLICATIONS

International Search Report issued in corresponding International application No. PCT/CN2021/092607, mailed Jan. 26, 2022.

(Continued)

*Primary Examiner* — James A Shriver, II
*Assistant Examiner* — Hilary L Johns

(57) ABSTRACT

An ice and snow dual-purpose sliding device includes: a shoe cover main body. An accommodating cavity is disposed on a top of the shoe cover main body. The accommodating cavity is matched with a shoe and configuring to receive the shoe. A bottom of the shoe cover main body includes a first area, a second area, and a third area. The second area is horizontally disposed. Two sliding devices are disposed on the second area in a protruding mode. The two sliding devices are in a rail shape to slide on an ice surface or a snowfield. First accelerating devices are detachably disposed on the two sliding devices. Second accelerating devices are detachably disposed on the first area. Braking devices are detachably disposed on the third area. The first area and the third area incline upwards relative to the second area.

10 Claims, 4 Drawing Sheets

(58) Field of Classification Search
CPC .. A63C 3/04; A63C 1/06; A63C 5/025; A63C 1/30; A63C 1/00; A63C 3/00; A63C 13/00; A43B 3/16; A43B 5/18; A43B 13/26; A43B 5/185; A43C 15/00; A43C 15/02; A43C 15/161; A43C 15/061; A43C 15/06
USPC ..... 280/11.12
See application file for complete search history.

(56) References Cited

U.S. PATENT DOCUMENTS

| | | | | |
|---|---|---|---|---|
| D781,544 | S * | 3/2017 | Livingston | D2/962 |
| 9,756,897 | B1 * | 9/2017 | Millis | A63C 3/00 |
| 10,441,871 | B2 * | 10/2019 | Yi | A63C 5/025 |
| 2002/0017771 | A1 * | 2/2002 | McManus | A63C 5/02 280/600 |
| 2002/0175497 | A1 * | 11/2002 | Freemon | A63C 7/1066 280/605 |
| 2005/0193588 | A1 * | 9/2005 | Dombowsky | A43C 15/02 36/7.5 |
| 2008/0301973 | A1 * | 12/2008 | Lee Tsai | A43C 15/061 36/73 |
| 2012/0227204 | A1 * | 9/2012 | Maye | A63C 3/00 15/237 |
| 2016/0213102 | A1 * | 7/2016 | Girard | A43B 13/26 |
| 2019/0070482 | A1 * | 3/2019 | Yi | A63C 5/02 |

FOREIGN PATENT DOCUMENTS

| | | | | |
|---|---|---|---|---|
| CN | 106063988 | | 11/2016 | |
| CN | 106063988 | A * | 11/2016 | A63C 1/36 |
| CN | 207126094 | U | 3/2018 | |
| CN | 110585688 | | 12/2019 | |
| CN | 212631681 | | 3/2021 | |
| CN | 212631681 | U * | 3/2021 | |
| DE | 202014101431 | U1 | 4/2014 | |
| TW | M315514 | U | 7/2007 | |

OTHER PUBLICATIONS

Written Opinion of the International Search Authority in corresponding International application No. PCT/CN2021/092607, mailed Jan. 26, 2022.

* cited by examiner

ICE AND SNOW DUAL-PURPOSE SLIDING DEVICE

TECHNICAL FIELD

The present disclosure relates to a field of sliding equipment, and in particular to an ice and snow dual-purpose sliding device.

BACKGROUND

Skiing/skating is a favorite outdoor sport among people. According to the perspective of historical evolution, the skiing is divided into ancient skiing, modern skiing, and modern skiing. According to the conditions of skiing and purposes of participation, the skiing is divided into practical skiing, competitive skiing, and tourist recreational skiing. Moreover, the skating has a long history.

However, conventional ice and snow sliding sports equipment, such as an ice surface entertainment-sliding device disclosed by Chinese patent number 201720557477.9, is configured to slide on an ice surface for people, which cannot allow people to slide on a snow surface and cannot be universally used for ice and snow. Therefore, ice/snow fields and scenes cannot be considered at the same time, resulting in low universality of the fields and scenes and high requirements on technical threshold of users, so that user experience is low. Meanwhile, the conventional ice and snow sliding sports equipment cannot change a sliding speed thereof according to user group and user requirements, resulting in a small applicable group range of the conventional ice and snow sliding sports equipment.

SUMMARY

In order to solve above problems, the present disclosure provides an ice and snow dual-purpose sliding device, which is applied in both and ice surface and a snow surface, greatly reduces use technical threshold of users, seamlessly switches between sliding on the ice surface and the snow surface, has adjustable sliding speed, and is safe.

The present disclosure is realized through following technical scheme:

The present disclosure provides the ice and snow dual-purpose sliding device including a shoe cover main body. The shoe cover main body is integrally formed. An accommodating cavity is disposed on a top of the shoe cover main body. The accommodating cavity is matched with a shoe and is configured to receive the shoe. A bottom of the shoe cover main body includes a first area, a second area, and a third area. The second area is disposed between the first area and the third area. The second area is horizontally disposed. Two sliding devices are disposed on the second area in a protruding mode. The two sliding devices are in a rail shape to slide on an ice surface or a snowfield. First accelerating devices are detachably disposed on the two sliding devices. Second accelerating devices are detachably disposed on the first area. Braking devices are detachably disposed on the third area. The first area and the third area incline upwards relative to the second area, so that end surfaces of the second accelerating devices and end surfaces of the braking devices do not protrude out of end surfaces of the two sliding devices.

Furthermore, the first accelerating devices slide on the two sliding devices. A fixing component is disposed on each of the sliding devices to prevent a corresponding first accelerating device from sliding on a corresponding sliding device.

Furthermore, a first fixing hole is defined on each of the first accelerating devices. A second fixing hole is defined on each of the sliding devices. When each first fixing hole is communicated with a corresponding second fixing hole, each fixing component sequentially passes through a corresponding first fixing hole and a corresponding second fixing hole and limits sliding of a corresponding first accelerating device on a corresponding sliding device.

Furthermore, a sliding strip is disposed on each of the sliding devices. A sliding groove is defined on each of the first accelerating devices. Each sliding strip is embedded into a corresponding sliding groove and slides in the corresponding sliding groove.

Furthermore, a side surface of each of the sliding devices includes a first section and a second section. Each second section is obliquely disposed relative to the second area. An included angle between the first section and the second section is 10-170 degrees.

Furthermore, each sliding strip is disposed on a corresponding first section. Each of the first accelerating devices includes a limiting block. Each limiting block is embedded between a corresponding first section and a corresponding second section and does not limit sliding of a corresponding first accelerating device on a corresponding sliding device.

Furthermore, the first area includes first screw holes. The second accelerating devices are one-to-one screwed with the first screw holes.

Furthermore, the second area includes second screw holes. The braking devices are one-to-one screwed with the second screw holes.

Furthermore, a structure of each of the second accelerating devices is same as a structure of each of the braking devices. Each of the second accelerating devices includes a tip portion, a connecting table fixedly connected to the tip portion, and a stud fixedly connected to the connecting table.

Furthermore, the shoe cover main body includes a base and a clamping belt. The clamping belt is fixedly connected to the base and extends upwards relative to the base. The clamping belt is disposed in a closed mode. The accommodating cavity is defined on the base. A limiting opening is defined between the clamping belt and the base. The limiting opening is configured to limit the shoe from separating from the accommodating cavity. The limiting opening is communicated with the accommodating cavity.

Compared with a sliding device in the prior art, the ice and snow dual-purpose sliding device provided by the present disclosure includes the two sliding devices disposed in parallel and of the rail shape. The two sliding devices are simultaneously suitable for the ice and snow surfaces, allowing the ice and snow dual-purpose sliding device to simultaneously consider ice/snow fields and other scenarios. The present disclosure has characteristics of high universality of fields and scenes, and realizes seamless switching of sliding on the ice and snow surfaces.

The ice and snow dual-purpose sliding device provided by the present disclosure includes the accommodating cavity matched with the shoe and configured to receive the shoe, so that the user is able to directly use the device through fitting the shoe into the accommodating cavity, which greatly reduces the technical threshold for the users to use.

The ice and snow dual-purpose sliding device provided by the present disclosure comprises the first accelerating devices, the second accelerating devices, and the braking devices. The first accelerating devices are disassembled and assembled according to actual needs of the users and have characteristics of meeting various application scenarios, adjustable speed, and safety.

Figure 1:
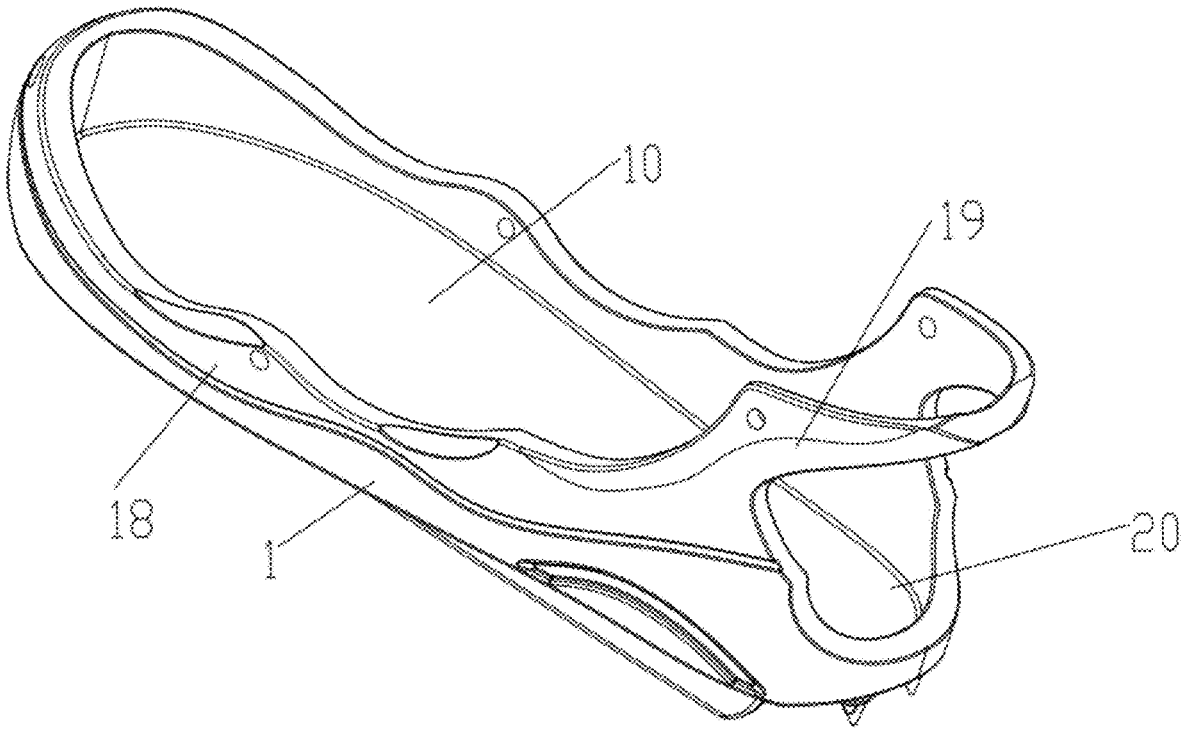
FIG. 1 is a structural schematic diagram of an ice and snow dual-purpose sliding device according to one embodiment of the present disclosure.
Figure 2:
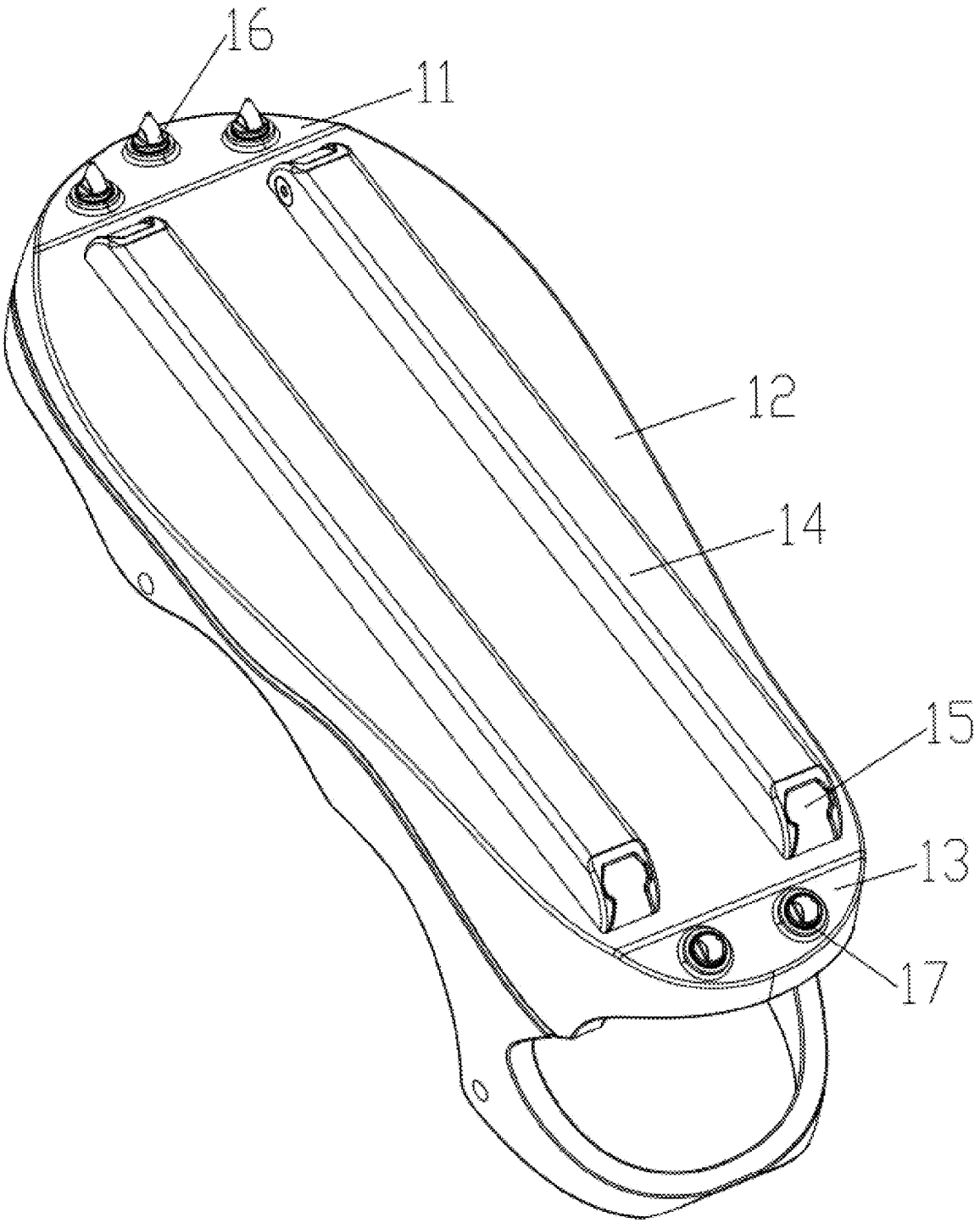
FIG. 2 is another structural schematic diagram of the ice and snow dual-purpose sliding device according to one embodiment of the present disclosure.
Figure 3:
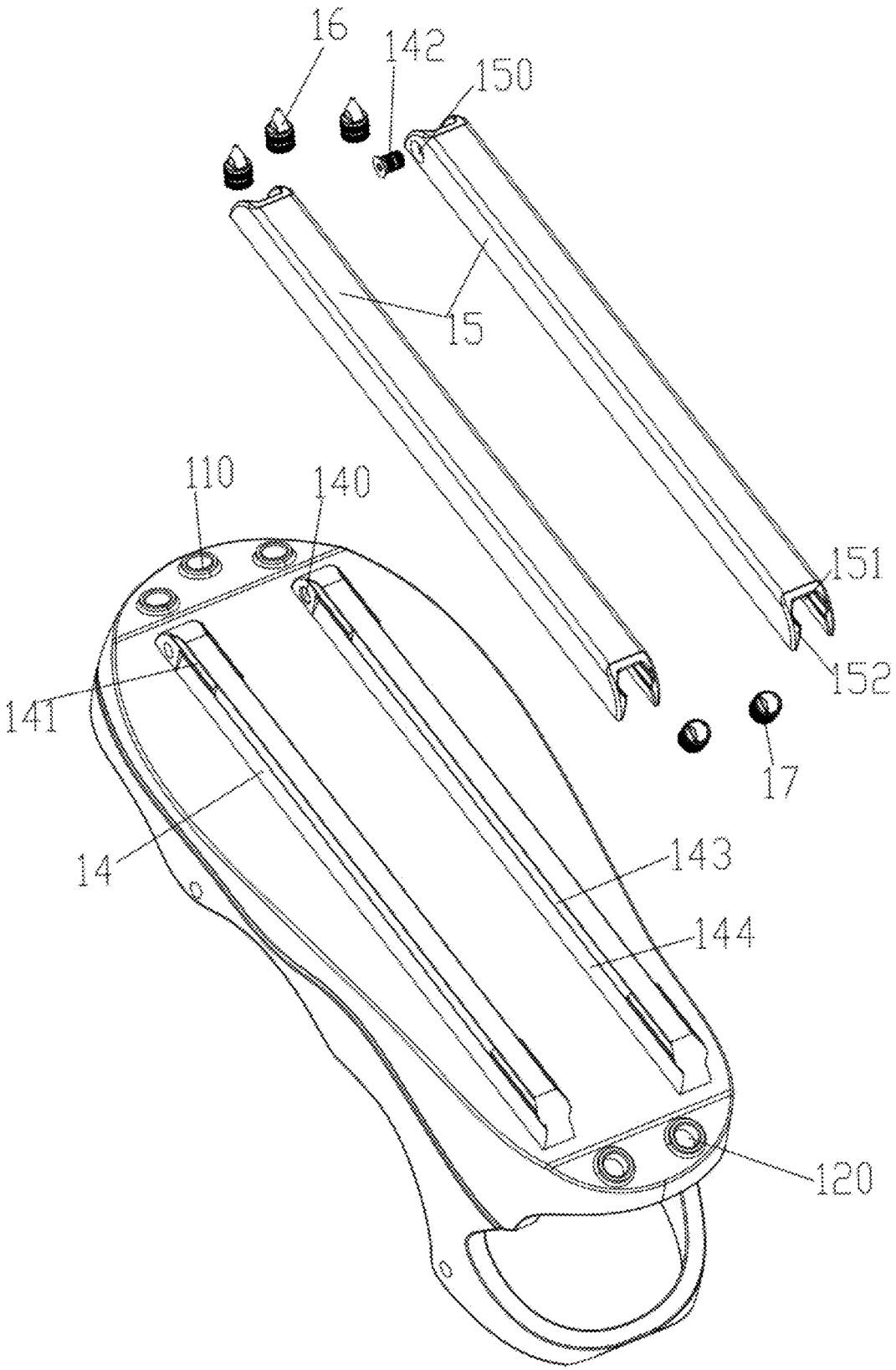
FIG. 3 is an exploded schematic diagram of the ice and snow dual-purpose sliding device according to one embodiment of the present disclosure.
Figure 4:
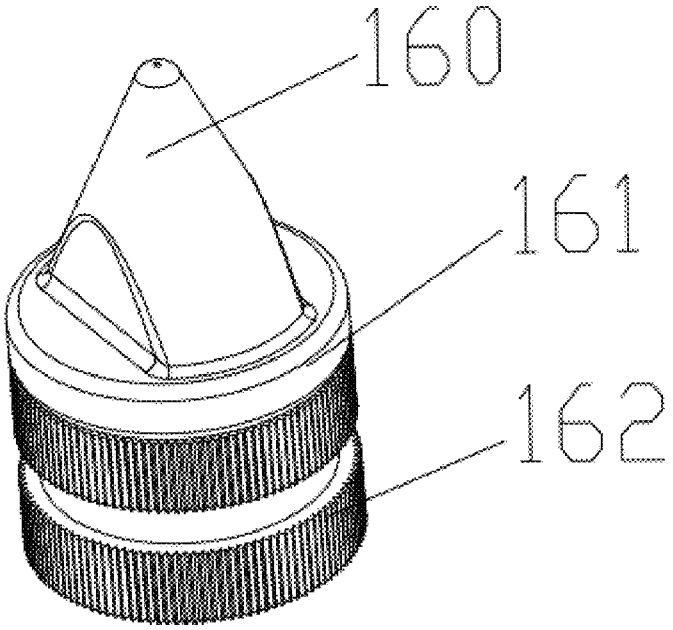
FIG. 4 is a structural schematic diagram of a second accelerating device or a braking device of the ice and snow dual-purpose sliding device according to one embodiment of the present disclosure.

Reference number in the drawings: 1. shoe cover main body; 10. accommodating cavity; 11. first area; 12. second area; 13. third area; 14. sliding devices; 15. first accelerating devices; 16. second accelerating devices; 17. braking devices; 120. second screw hole; 110. first screw hole; 142. fixing component; 150. first fixing hole; 140. second fixing hole; 141. sliding strip; 151. sliding groove; 152. limiting block; 143. first section; 144. second section; 160. tip portion; 161. connecting table; 162. stud; 18. base; 19. clamping belt; 20. limiting opening.

DETAILED DESCRIPTION

In order to more clearly and completely explain technical solutions of the present disclosure, following is a further explanation of the present disclosure in conjunction with accompanying drawings.

As shown in FIG. 1, the present disclosure provides an ice and snow dual-purpose sliding device including a shoe cover main body 1 that is integrally formed. An accommodating cavity 10 is disposed on a top of the shoe cover main body 1. The accommodating cavity 10 is matched with a shoe and is configured to receive the shoe. A bottom of the shoe cover main body 1 includes a first area 11, a second area 12, and the third area 13. The second area 12 is disposed between the first area 11 and the third area 13. The second area 12 is horizontally disposed. Two sliding devices 14 are disposed on the second area 12 in a protruding mode. The two sliding devices 14 are in a rail shape so the two sliding devices are slidable on an ice surface or a snowfield. First accelerating devices 15 are detachably disposed on the two sliding devices 14. Second accelerating devices 16 are detachably disposed on the first area 11. Braking devices 17 are detachably disposed on the third area 13. The first area 11 and the third area 13 incline upwards relative to the second area 12, so that end surfaces of the second accelerating devices 16 and end surfaces of the braking devices 17 do not protrude out of end surfaces of the two sliding devices 14.

In one optional embodiment of the present disclosure, the two sliding devices 14 are disposed in parallel. Certainly, in other embodiments of the present disclosure, the two sliding devices 14 are unparalleled.

In the embodiment, the shoe cover main body 1 is an integrally-formed plastic component. The shoe cover main body 1 is of an integrally-formed structure, which conveniently improves production efficiency of the shoe cover main body 1.

In the embodiment, the accommodating cavity 10 is disposed on a top of the shoe cover main body 1, and the accommodating cavity 10 is matched with the shoe and is configured to receive the shoe. A user does not need to take off the shoe, but directly sleeve the shoe in the accommodating cavity 10, and slide on an ice/snow field through the ice and snow dual-purpose sliding device, making it convenient for the user to wear and greatly reducing technical threshold for the user to use.

In other embodiments of the present disclosure, the accommodating cavity 10 is configured to receive a foot of a human body, so that the user is able to directly wear the ice and snow dual-purpose sliding device.

In the embodiment, the second area 12 is horizontally disposed. When the user slides on the snowfield, the second area 12 supports on the snowfield, and even if the two sliding devices 14 is sunk into the snowfield to generate certain resistance, the ice and snow dual-purpose sliding device still slides smoothly on the snowfield. The two sliding devices 14 are disposed in parallel, and the two sliding devices 14 are in the rail shape. When the two sliding devices 14 slide on the ice surface, the two sliding devices 14 support on the ice surface, the second area 12 does not contact the ice surface, and at this time, the ice and snow dual-purpose sliding device slides smoothly on the ice surface. Therefore, the ice and snow dual-purpose sliding device can be applied in both the ice filed and the snowfield, has characteristics of high universality of fields and scenes, and realizes seamless switching of sliding on the ice and snow surfaces.

In the embodiment, the first accelerating devices 15 are made of a metal material with a certain hardness, such as steel or other composite metal materials. When the user need to improve sliding speed on the ice surface, the first accelerating devices 15 are installed on the two sliding devices 14, so that the sliding speed is remarkably increased when the user slides on the ice surface. When the user needs to reduce the sliding speed on the ice surface, the first accelerating devices 15 are removed from the two sliding devices 14, and the sliding speed on the ice surface is reduced. The first accelerating devices 15 are detachably disposed through disposing the two sliding devices 14, so that the ice and snow dual-purpose sliding device has a function of adjusting the sliding speed, which expands use type of the users and meets requirements of more users. Meanwhile, the first accelerating devices 15 are detachably installed, and when the first accelerating devices 15 are abraded or damaged, the first accelerating devices 15 are replaced, which prolongs service life of the ice and snow dual-purpose sliding device.

In the embodiment, by disposing the second accelerating devices 16, the sliding speed is further increased. By disposing the braking devices 17, braking is carried out during sliding through the braking devices 17, reducing the sliding speed and making it safer during sliding.

In the embodiment, the second accelerating devices 16 and the braking devices 17 are both detachably disposed, and when the second accelerating devices 16 and the braking devices 17 are worn or damaged, the second accelerating devices 16 and the braking devices 17 are replaced, which prolongs the service life of the ice and snow dual-purpose sliding device.

Furthermore, the first accelerating devices 15 are slidable on the two sliding devices 14. A fixing component 142 is disposed on each of the sliding devices 14 to prevent each of the first accelerating devices 15 from sliding on a corresponding sliding device 14.

Furthermore, a first fixing hole 150 is defined on each of the first accelerating devices 15. A second fixing hole 140 is defined on each of the sliding devices 14. When each first fixing hole 150 is communicated with a corresponding second fixing hole 140, each fixing component 142 sequentially passes through a corresponding first fixing hole 150 and a corresponding second fixing hole 140 so as to limit sliding of each of the first accelerating devices 15 on the corresponding sliding devices 14.

In the embodiment, each fixing component 142 is a stud, each first fixing hole 150 and each second fixing hole 140 are circular holes adapted to an outer diameter of each fixing component 142, and threads are disposed on an inner wall of each second fixing hole 140. When installing the first accelerating devices 15, each of the first accelerating devices 15 slide on the corresponding sliding device 14 to enable each first fixing hole 150 to be communicated with the corresponding second fixing hole 140, then each fixing component 142 passes through the corresponding first fixing hole 150 and the corresponding second fixing hole 140 in sequence, and then each fixing component 142 is fastened and screwed with the corresponding second fixing hole 140 through using a tool, so that a mounting work of the first accelerating devices 15 is completed.

Furthermore, a sliding strip 141 is disposed on each of the sliding devices 14. A sliding groove 151 is defined on each of the first accelerating devices 15. Each sliding strip 141 is embedded into a corresponding sliding groove 151 and slides in the corresponding sliding groove 151.

In the embodiment, each sliding groove 151 is matched with a corresponding sliding strip 141, achieving rapid positioning between the two sliding devices 14 and the first accelerating devices 15, and enabling the first accelerating devices 15 to be quickly installed.

Furthermore, a side surface of each of the sliding devices 14 includes a first section 143 and a second section 144. Each second section 144 is obliquely disposed relative to the second area 12. An included angle between each first section 143 and a corresponding second section 144 is 10-170 degrees.

Optionally, the included angle between each first section 143 and the corresponding second section 144 is 120-150 degrees.

Furthermore, each sliding strip 141 is disposed on a corresponding first section 143. Each of the first accelerating devices 15 includes a limiting block 152. Each limiting block 152 is embedded between a corresponding first section 143 and a corresponding second section 144 and does not limit sliding of the corresponding first accelerating devices 15 on the corresponding two sliding devices 14.

In the embodiment, an outer surface of each limiting block 152 is completely matched with a corresponding first section 143 and a corresponding second section 144. Each limiting block 152 is embedded between the corresponding first section 143 and the corresponding second section 144, and each limiting block 152 is attached to the corresponding first section 143 and the corresponding second section 144. Positioning relationship between each limiting block 152, the corresponding first section 143, and the corresponding second section 144 increases fixing force between the first accelerating devices 15 and the two sliding devices 14.

In the embodiment, each sliding strip 141 is embedded in the corresponding sliding groove 151, and each limiting block 152 is embedded in the corresponding first section 143 and the corresponding second section 144, which prevents the first accelerating devices 15 from swinging relative to the two sliding devices 14, and improves safety during sliding.

Furthermore, the first area 11 includes first screw holes 110. The second accelerating devices 16 are one-to-one screwed with the first screw holes 110.

Furthermore, the second area 12 includes second screw holes 120. The braking devices 17 are one-to-one screwed with the second screw holes 120.

In the embodiment, detachable installation of the second accelerating devices 16 and the braking devices 17 is achieved by a threaded connection method, and the second accelerating devices 16 and the braking devices 17 have good fixation force, so that after installation, the second accelerating devices 16 and the braking devices 17 are fixed and stabilized in the first area 11 and the second area 12.

In the embodiment, the first area 11 and the second area 12 are both include hole positions. Inserting components are one-to-one embedded in the hole positions, and the first screw holes 110 and the second screw holes 120 are one-to-one defined on the inserting components. The inserting components are made of the metal material, which is same as a material of each of the second accelerating devices 16 and a material of each of the braking devices 17. In this way, the fixing force between each of the second accelerating devices 16 and a corresponding first screw hole 110 and the fixing force between each of the braking devices 17 and a corresponding second screw hole 120 are increased.

Furthermore, a structure of each of the second accelerating devices 16 is same as a structure of each of the braking devices 17. Each of the second accelerating devices 16 includes a tip portion 160, a connecting table 161 fixedly connected to the tip portion 160, and a stud 162 fixedly connected to the connecting table 161.

In the embodiment, threaded connection is achieved through cooperation of each stud 162 with a corresponding first screw hole 110 and a corresponding second screw hole 120. By disposing each tip portion 160, friction force between each tip portion 160 and an ice/snow surface is increased, thereby facilitating an accelerating or braking operation.

In the embodiment, a shape of each tip portion 160 includes, but is not limited to, a spike shape, a sawtooth shape, a columnar shape, a tooth shape, etc.

Furthermore, the shoe cover main body 1 includes a base 18 and a clamping belt 19. The clamping belt 19 is fixedly connected to the base 18 and extends upwards relative to the base 18. The clamping belt 19 is disposed in a closed mode. The accommodating cavity 10 is defined on the base 18. A limiting opening 20 is formed between the clamping belt 19 and the base 18. The limiting opening 20 is configured to limit the shoe from separating from the accommodating cavity 10. The limiting opening 20 is communicated with the accommodating cavity 10.

In the embodiment, the clamping belt 19 and the base 18 are detachably disposed, so that the user conveniently replaces or uses the clamping belt 19 and the base 18 according to actual conditions.

Of course, the present disclosure further has other various embodiments. Based on the embodiment, other embodiments are obtained by a person of ordinary skill in art on a premise of not making any creative work, and all belong to a protection scope of the present disclosure.

What is claimed is:

1. An ice and snow dual-purpose sliding device, comprising: a shoe cover main body;

wherein the shoe cover main body is integrally formed; an accommodating cavity is disposed on a top of the shoe cover main body; the accommodating cavity is matched with a shoe and is configured to receive the shoe; a bottom of the shoe cover main body comprises a first area, a second area, and a third area; the second area is disposed between the first area and the third area; the second area is horizontally disposed; two sliding devices are disposed on the second area in a protruding mode; the two sliding devices are in a rail shape to enable the two sliding devices slidable on an ice surface or a snowfield; first accelerating devices are detachably disposed on the two sliding devices; second accelerating devices are detachably disposed on the first area; braking devices are detachably disposed on the third area, and the first area and the third area incline upwards relative to the second area, so that end surfaces of the second accelerating devices and end surfaces of the braking devices do not protrude out of end surfaces of the two sliding devices.

2. The ice and snow dual-purpose sliding device according to claim 1, wherein the first accelerating devices are slidable on the two sliding devices, and a fixing component is disposed on each of the sliding devices to prevent the first accelerating devices from sliding on the two sliding devices.

3. The ice and snow dual-purpose sliding device according to claim 2, wherein a first fixing hole is defined on each of the first accelerating devices; a second fixing hole is defined on each of the sliding devices; when each first fixing hole is communicated with a corresponding second fixing hole, each fixing component sequentially passes through a corresponding first fixing hole and a corresponding second fixing hole and limits sliding of a corresponding first accelerating device on a corresponding sliding device.

4. The ice and snow dual-purpose sliding device according to claim 2, wherein a sliding strip is disposed on each of the sliding devices; a sliding groove is defined on each of the first accelerating devices; each sliding strip is embedded into a corresponding sliding groove and slides in the corresponding sliding groove.

5. The ice and snow dual-purpose sliding device according to claim 4, wherein a side surface of each of the sliding devices comprises a first section and a second section; each second section is obliquely disposed relative to the second area; an included angle between each first section and a corresponding second section is 10-170 degrees.

6. The ice and snow dual-purpose sliding device according to claim 5, wherein each sliding strip is disposed on a corresponding first section; each of the first accelerating devices comprises a limiting block; each limiting block is embedded between a corresponding first section and a corresponding second section and does not limit sliding of each of the first accelerating devices on a corresponding sliding device.

7. The ice and snow dual-purpose sliding device according to claim 1, wherein the first area comprises first screw holes, and the second accelerating devices are one-to-one screwed with the first screw holes.

8. The ice and snow dual-purpose sliding device according to claim 1, wherein the second area comprises second screw holes, and the braking devices are one-to-one screwed with the second screw holes.

9. The ice and snow dual-purpose sliding device according to claim 1, wherein a structure of each of the second accelerating devices is same as a structure of each of the braking devices; each of the second accelerating devices comprises a tip portion, a connecting table fixedly connected to the tip portion, and a stud fixedly connected to the connecting table.

10. The ice and snow dual-purpose sliding device according to claim 1, wherein the shoe cover main body comprises a base and a clamping belt; the clamping belt is fixedly connected to the base and extends upwards relative to the base; the clamping belt is disposed in a closed mode; the accommodating cavity is defined on the base; a limiting opening is formed between the clamping belt and the base; the limiting opening is configured to limit the shoe from separating from the accommodating cavity; the limiting opening is communicated with the accommodating cavity.

* * * * *